US005636958A

United States Patent [19]

Foldesi et al.

[11] Patent Number: 5,636,958

[45] Date of Patent: Jun. 10, 1997

[54] SLITTER FOR TAMPER-EVIDENT CLOSURES

[75] Inventors: Steven Foldesi; Steven Foldesi, Jr., both of Laval, Canada

[73] Assignee: Nestech Machine Systems, Inc., Hinesburg, Vt.

[21] Appl. No.: 386,439

[22] Filed: Feb. 10, 1995

[51] Int. Cl.[6] ..... B21D 51/50; B26D 3/08; B26D 1/12

[52] U.S. Cl. ..... 413/10; 83/678; 83/879; 83/946

[58] Field of Search ..... 413/10, 12, 67; 83/676, 678, 879, 880, 946; 264/154; 425/809; 215/252, 253

[56] References Cited

U.S. PATENT DOCUMENTS

| | | | |
|---|---|---|---|
| 1,919,578 | 7/1933 | Stephens | 413/10 |
| 2,056,778 | 10/1936 | Fabrice | 215/42 |
| 3,311,077 | 3/1967 | Andrew et al. | 113/1 |
| 3,323,276 | 6/1967 | Thomas | 413/10 |
| 3,416,474 | 12/1968 | Musy | 113/1 |
| 3,757,618 | 9/1973 | Kuts | 83/676 |
| 3,824,941 | 7/1974 | Idannon | 413/10 |
| 3,859,942 | 1/1975 | Moller | 413/10 |
| 4,185,576 | 1/1980 | George | 413/10 |
| 4,377,084 | 3/1983 | Kaminski | 413/67 |
| 4,823,537 | 4/1989 | Duke | 413/10 |

*Primary Examiner*—Joseph J. Hail, III
*Assistant Examiner*—Eziamara A. Ojini
*Attorney, Agent, or Firm*—Charles E. Temko

[57] ABSTRACT

A rotary slitter for container closures of varying sizes is disclosed. The embodiments include swivel housings to permit rapid changing of internal tools, and a rectilinear knife blade which eliminates adjustment problems normally occurring with curved knife blades.

3 Claims, 3 Drawing Sheets

SLITTER FOR TAMPER-EVIDENT CLOSURES

BACKGROUND OF THE INVENTION

This invention relates generally to the field of rotary slitters used for forming closures for containers particularly those which include tamper-evident rings which are separated from the skirt portion of the closure when the closure is first removed.

The slitting of roll-on closures is an old well-developed art. The slitting of aluminum soft drink caps, for example, is accomplished on a rotary threader using a curved knife blade segment. The severable bridges are the result of slots in the knife blade segment. More slots form more bridges. Wider slots form stronger bridges.

In the prior art rotary slitter, a main dial rotates about a stationary hub. Internal tools are mounted on the dial and move with it. The number of tools is determined by the required number of caps per minute output. Typically, eighty caps per minute per spindle is normal.

A star gear is stationary and mounted on the hub. As the dial rotates, the star gear rotates the spindle eliminating slipping of the internal tool. The closures are picked up by the internal tool, rotated over the knife segment to produce the slots and subsequently discharge. A curved knife segment is mounted on a stationary seat ring on the stationary hub.

There are two major shortcomings when using the above described structure.

A first is the fact that the machines are dedicated to a particular size cap. To make caps of another size requires another machine. Cost is normally not a critical factor where the volume is very high, but can be a major concern in the case of forming food container closures where sizes are larger and volumes are smaller.

A second problem relates to the adjustment of the curved knife which is periodically required. Maintaining even contact with the cap is of paramount importance. As the caps rotate over the knife segment, the cuts and the interconnecting bridges will change as the knife segment is adjusted upwardly or downwardly. To provide a deeper penetration, the segment is shimmed up. This is usually necessary after a sharpening operation. However, when reset, the center of the knife segment is higher than the end portions. When lowered, the end portions are higher. This factor results in uneven bridge strength.

SUMMARY OF THE INVENTION

Briefly stated, the invention contemplates the provision of an improved rotary slitter of the type described in which the above problems have been addressed.

To facilitate the slitting of closures of varying diameters, the internal tools are mounted on a swivel housing, whereby they may be easily changed.

To eliminate the problem of adjusting a curved knife segment, the same is replaced by a rectilinear knife blade. Additional benefits of this substitution are savings in the cost of manufacture, and the ability to use the blade for several sizes of closure. Only one set of external tools is required.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
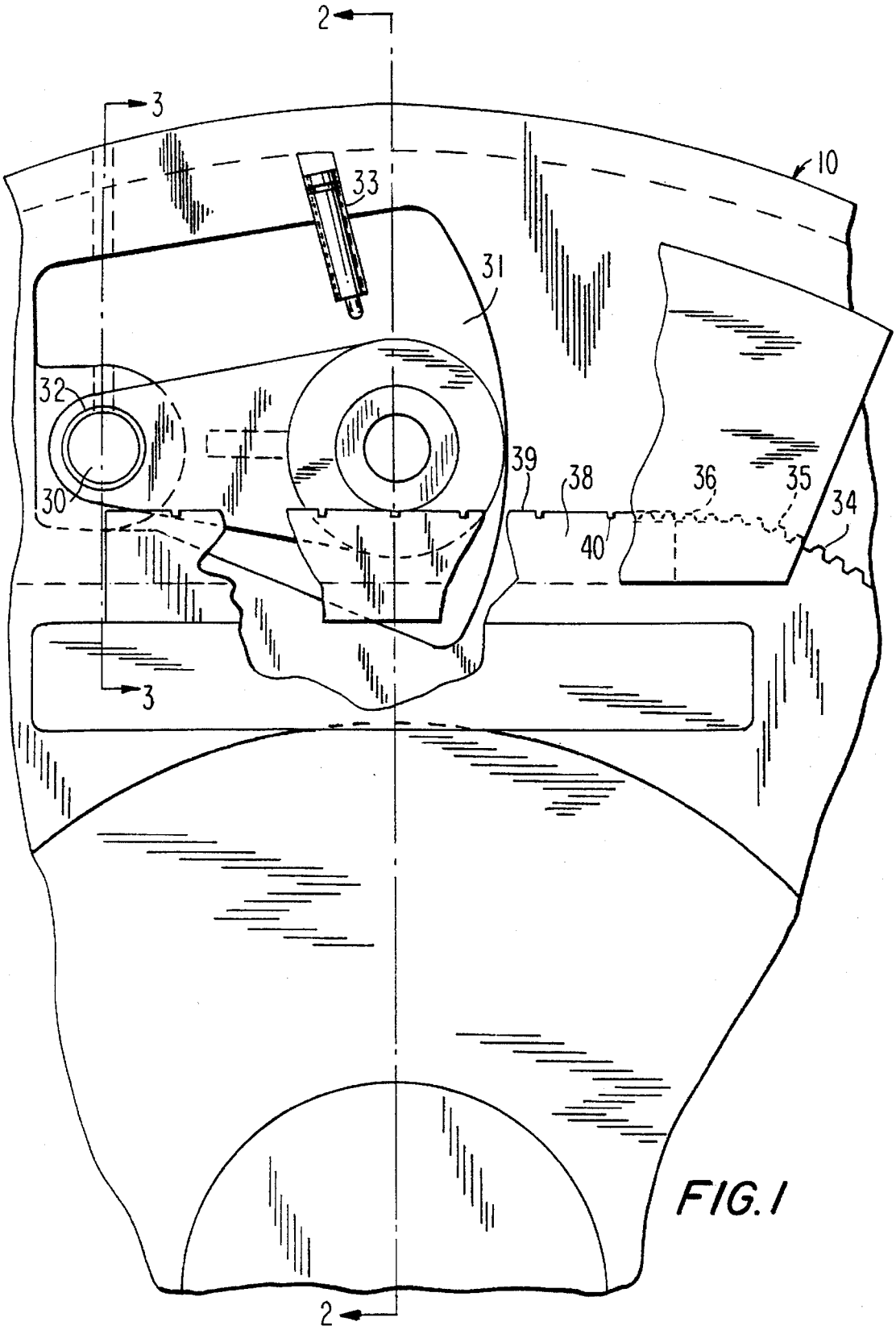
FIG. 1 is a fragmentary side elevational view of a first embodiment of the invention.

In accordance with the invention, the device, generally indicated by reference character 10, comprises a stationary center hub 11 held in fixed relationship by a machine mount 12 in a manner known in the art. Disposed within a recess 13 in the hub 11 is a segment seat ring 14. A second recess 15 supports a gear mounting hub 16 for a sun gear 17. A main dial 18 mounts a plurality of star gears, one of which is indicated by reference character 19 which engage the sun gear and exhibit orbital motion in known manner.

The star gears are carried on one end of an internal tool 20 in turn supported on bearings 21 to permit them to rotate relative to a supporting arbor 24. The tool 20 includes an ejector pin 25 for removing caps 26 after completion of the slitting operation. The caps are held in position by a segmented. pressure plate 27 during the slitting operation. When the slitting operation is completed, a cam 28 operates the ejector pin 25 to remove the cap from the internal tool, as is known in the art.

Referring to FIG. 1, as contrasted with the prior art construction, the arbor is not in fixed radial position relative to the axis of the sun gear. A pivot pin 30 supports an arbor housing 31 for pivotal movement about a bronze bushing 32. A resilient bumper 33 urges the housing downwardly as seen in FIG. 1, so that the star gears 19 will remain in constant engagement with the sun gear 17.

The sun gear includes a tooth bearing periphery 34, but unlike the prior art, the periphery includes a plurality of curved gear segments 35 alternating with a plurality of rectilinear gear segments 36. A knife blade 38 includes a rectilinear cutting edge 39 including conventional slots 40 which form the frangible bridges of the closure. The knife blade 38 is maintained between pressure segments 41 and 42 which permit vertical adjustment after sharpening operations. The sharpened edge of the blade is adjustably supported for vertical movement, such that the cutting edge 39 remains horizontal at all times.

Figure 3:
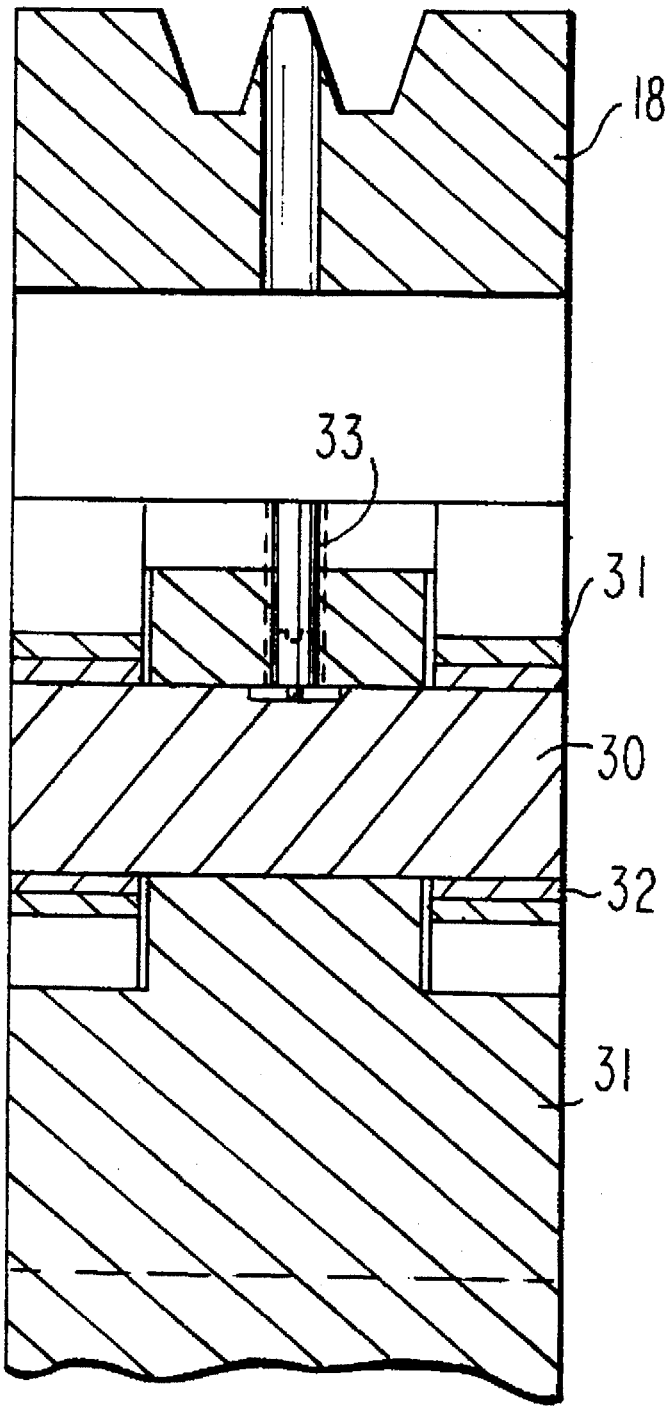
FIG. 3 is a fragmentary vertical sectional view as seen from the plane 3—3 in FIG. 1.

Operation of the device will be understood from a consideration of FIGS. 1 and 3. The device 10 operates generally in normal manner, except that the cutting edge 39 of the knife blade 38 engages individual closures or caps when the rectilinear segments 36 of the sun gear are engaged with an individual star gear. During cutting, the cap moves along a horizontal axis while executing a complete revolution during which time the slitting function is performed. During the time the cap is ejected and a new cap is positioned, the star gears will be in engagement with the curved gear segments 35 as in the prior art.

Figure 2:
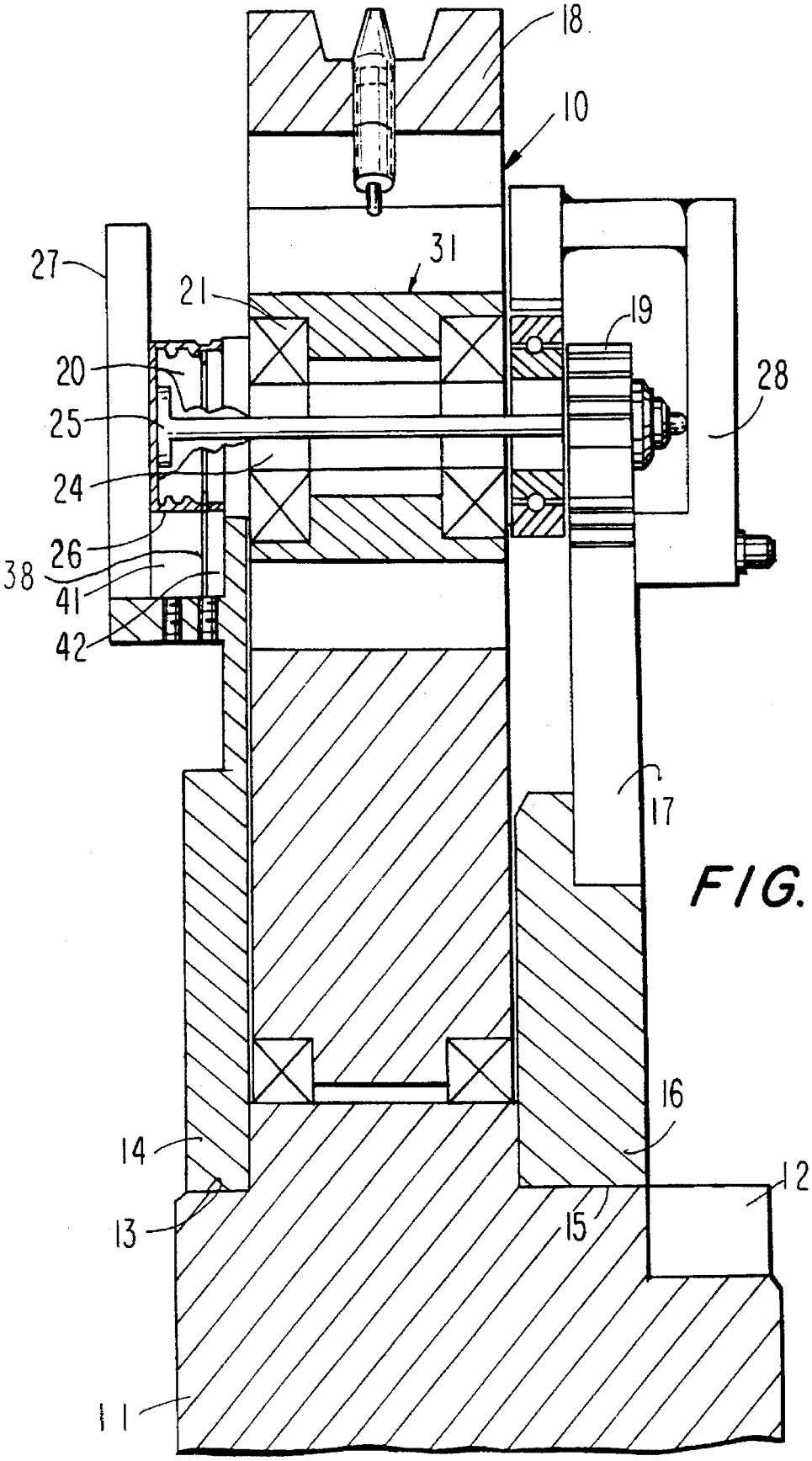
FIG. 2 is a vertical sectional view thereof, as seen from the plane 2—2 in FIG. 1.

When it is desired to slit a cap or closure which is of larger diameter than that illustrated in FIGS. 1 and 2, the arbor housing may be disconnected, and a larger internal tool substituted in the arbor, following which the housing is returned to engaged condition. This will result in the arbor housing being pivoted counterclockwise from the position shown in FIG. 1. When the closure is positioned, a greater length of the rectilinear segment of the knife edge will be employed, and depending upon the positioning of the bridges formed by the slots, it may be necessary to substitute another cutting blade. However, the same device 10 may be used for slitting caps of a variety of diameters within reasonable limit by simply providing additional internal tools and rectilinear cutting knives.

It is to be understood that it is not considered that the invention lies in the details of structure shown and set forth in the specification, for obvious modifications will occur to those skilled in the art to which the invention pertains.

What is claimed is:

1. In a rotary slitter for container closures for forming a separable tamper indicating ring on a skirt portion of said closures, said slitter including a relatively stationary hub mounting a sun gear, a rotating dial mounting a plurality of star gears engaging said sun gear, each of said star gears driving a rotary arbor supporting closures on an internal tool against a knife blade for slitting said skirt, the improvement comprising:

said sun gear having a tooth bearing periphery including alternately spaced arcuate and rectilinear segments, a pivotally mounted arbor housing rotationally supporting said arbor and shifting said arbor about a pivot point spaced from the axis of rotation of said arbor to enable said star gear to continuously engage both arcuate and rectilinear segments of said sun gear;

and a segmented slitting knife having a rectilinear cutting edge operative to slit closures when said star gear is engaged with a rectilinear segment of said sun gear.

2. The improvement in accordance with claim 1, further comprising resilient means for urging said star gears into continuous engagement with said sun gear.

3. The improvement in accordance with claim 1, said arbor housing having an arcuate path of motion sufficient to enable the positioning of internal tools of differing diameters upon said arbor.

* * * * *